US006482031B1

(12) United States Patent
Chen et al.

(10) Patent No.: US 6,482,031 B1
(45) Date of Patent: Nov. 19, 2002

(54) BOARD LOCK OF ELECTRICAL CONNECTOR

(75) Inventors: Chin-Yuan Chen, Taipei (TW); Danny Yin, Taipei (TW)

(73) Assignee: Tekcon Electronics Corp., Taipei (TW)

( * ) Notice: Subject to any disclaimer, the term of this patent is extended or adjusted under 35 U.S.C. 154(b) by 0 days.

(21) Appl. No.: 09/964,088

(22) Filed: Sep. 26, 2001

(51) Int. Cl.[7] ..... H01R 13/73
(52) U.S. Cl. ..... 439/567
(58) Field of Search ..... 439/567, 571, 439/572

(56) References Cited

U.S. PATENT DOCUMENTS 5,085,589 A * 2/1992 Kan ..... 439/567
5,108,312 A * 4/1992 Sampson ..... 439/567
5,137,245 A * 8/1992 Lee ..... 439/567
5,460,543 A * 10/1995 Kosmala ..... 439/567
5,593,307 A * 1/1997 Bale et al. ..... 439/567
6,293,822 B1 * 9/2001 Zhu et al. ..... 439/567

* cited by examiner

*Primary Examiner*—Gary F. Paumen

(57) ABSTRACT

A board lock for retaining an electrical connector on a printed circuit board is disclosed. The board lock includes an L-shaped body having a first section riveted to a housing of the connector and a second section perpendicularly extending from the first section. A channel-like portion is formed with the second section and has two side walls. A pawl is formed on the channel-like portion, including a first finger and a second finger extending from each of the side walls. The first finger has a concave, resilient portion forming a barbed free end. The second finger has a straight portion forming a barbed free end. The pawl is received in a hole defined in the printed circuit board with the barbed ends engaging an edge of the hole to retain the connector on the printed circuit board. The straight portions of second fingers reduce the force required for insertion of the pawl into the hole of the printed circuit board while the concave portions of the first fingers provide resiliency sufficient to effectively and securely retain the connector on the printed circuit board.

14 Claims, 4 Drawing Sheets

BOARD LOCK OF ELECTRICAL CONNECTOR

BACKGROUND OF THE INVENTION

1. Field of the Invention

The present invention relates generally to a board lock of an electrical connector, and in particular to a board lock having a four-finger pawl for securing the electrical connector to a printed circuit board.

2. Related Arts

Electrical connectors are widely used in a variety of electronic/electrical devices for providing electrical connection between electrical components. One of the commonly known applications of the electrical connectors is to connect an electrical device to a printed circuit board. Such connectors are usually mounted on the printed circuit board and form a mating portion to matingly engage a corresponding connector of the electrical device to be connected to the printed circuit board. Techniques for mounting an electrical connector to a printed circuit board includes surface-mount technique (SMT) and through-hole technique. Either one requires a soldering process for permanently securing the connector on the printed circuit board. To ensure proper position of the electrical connector on the printed circuit board, the connector must be temporarily retained on the printed circuit board before the soldering process takes place.

Board locks are commonly used to temporarily retain an electrical connector on a printed circuit board before a soldering process takes place. A variety of board locks have been developed for more effectively and securely retaining an electrical connector on a printed circuit board. U.S. Pat. No. 5,137,245 and Taiwan Patent Publication No. 154276, both assigned to the present applicant, disclose a board lock having a pawl comprising four resilient fingers substantially and angularly equally-spaced around a central axis of the pawl. Four fingers ensure a stable engagement between the board lock and a corresponding hole defined in a printed circuit board.

The conventional four-finger pawl based board lock, however, is disadvantageous in that a great effort must be taken in forcing the hooked ends of the four fingers though the hole of the printed circuit board.

It is thus desired to have a board lock requiring less effort in being mounted to a printed circuit board while maintaining stable engagement with the printed circuit board after being mounted thereto.

SUMMARY OF THE INVENTION

Thus, it is a primary object of the present invention to provide a board lock which can be readily mounted to a printed circuit board while effectively and stably retaining an electrical connector on the printed circuit board.

To achieve the above object, in accordance with the present invention, there is provided a board lock for temporarily retaining an electrical connector on a printed circuit board during a soldering process. The board lock comprises an L-shaped body having a first section riveted to a housing of the connector and a second section perpendicularly extending from the first section. A U-shaped channel-like portion is formed with the second section and has two side walls. A pawl is formed on the channel-like portion, comprising a first finger and a second finger extending from each of the side walls. The first finger has a concave, resilient portion forming a barbed free end. The second finger has a straight portion forming a barbed free end. The pawl is received in a hole defined in the printed circuit board with the barbed ends engaging an edge of the hole to retain the connector on the printed circuit board. The straight portions of the second fingers reduce the force required for insertion of the pawl into the hole of the printed circuit board while the concave portions of the first fingers provide resiliency sufficient to effectively and securely retain the connector on the printed circuit board The above and other objects and advantages of the present invention can be better understood by reading the following detailed description of preferred embodiments thereof with reference to the accompanying drawings, wherein:

DETAILED DESCRIPTION OF PREFERRED EMBODIMENTS

Figure 1:
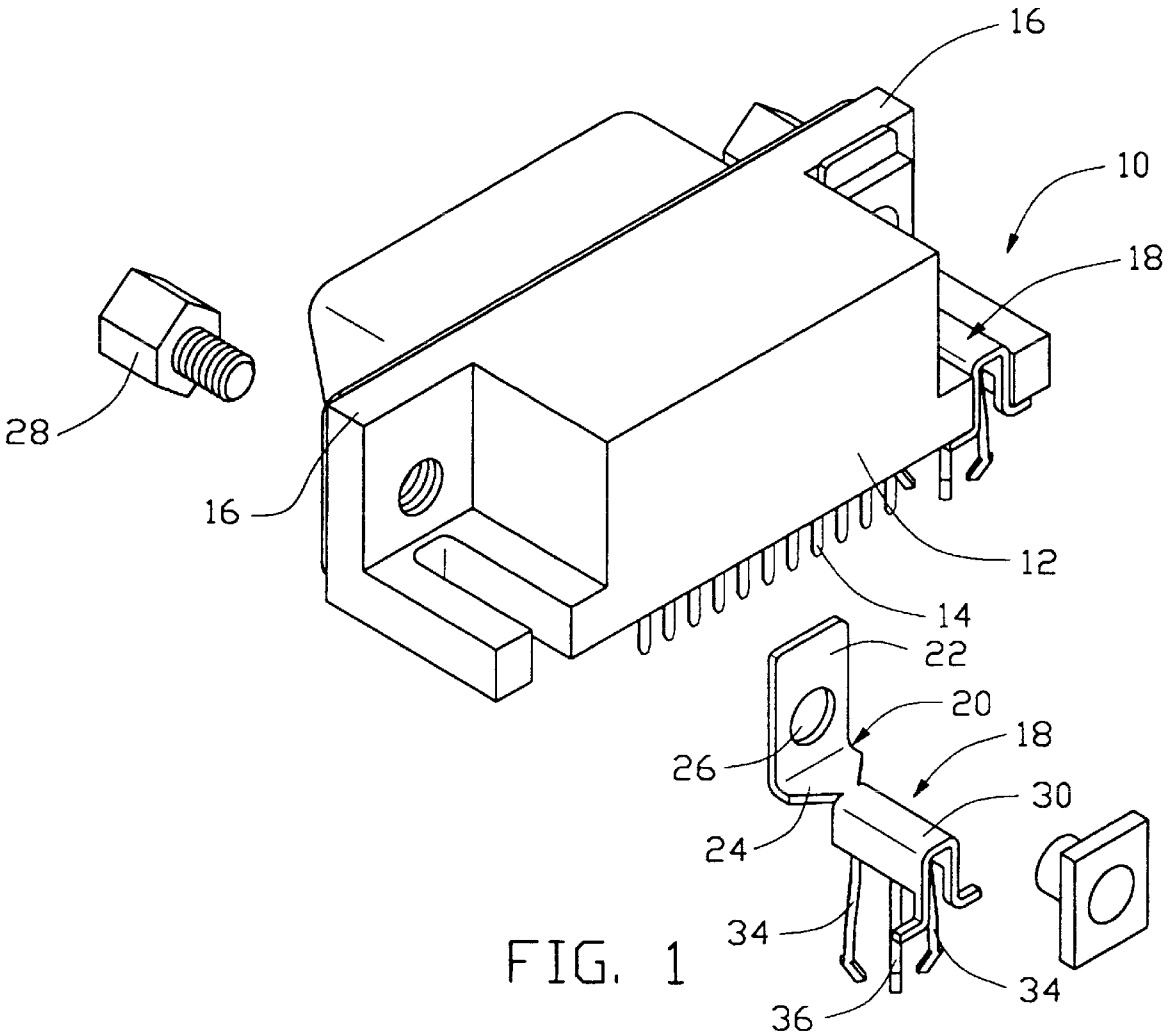
FIG. 1 is a perspective view showing an electrical connector incorporating board locks constructed in accordance with a first embodiment of the present invention.

With reference to the drawings and in particular to FIG. 1, an electrical connector, generally designated with reference numeral 10, comprises an insulative housing 12 retaining a plurality of conductive contacts 14 therein for electrically engaging a printed circuit board (not shown). Formed on opposite sides of the housing 12 is a pair of side wings 16 preferably integrally formed with the housing 12. A board lock 18 is attached to each side wing 16 for retaining the electrical connector 10 on the printed circuit board.

Also referring to FIGS. 2–5, the board lock 18 comprises an L-shaped body 20 having first and second sections 22, 24 substantially perpendicular to each other. The first section 22 defined a through hole 26 for receiving a fastener 28 that secures the board lock 18 to the side wing 16 of the housing 12. A U-shaped or channel-like section 30 is formed on a free end of the second section 24. The channel-like section 30 has opposite side walls 32. A pawl or board engaging structure (not labeled) includes a first finger 34 and a second finger 36 extending from each of the side walls 32 of the channel-like section 30. Thus, in total, four fingers 34, 36 are formed with each board lock 18. The fingers 34, 36 are arranged to spaced from each other and preferably, they are substantially and angularly equally spaced along an imaginary circular path as shown in the top view of FIG. 3. The first and second fingers 34, 36 alternate each other whereby the first (second) fingers 34 (36) are opposing each other.

Figure 4:
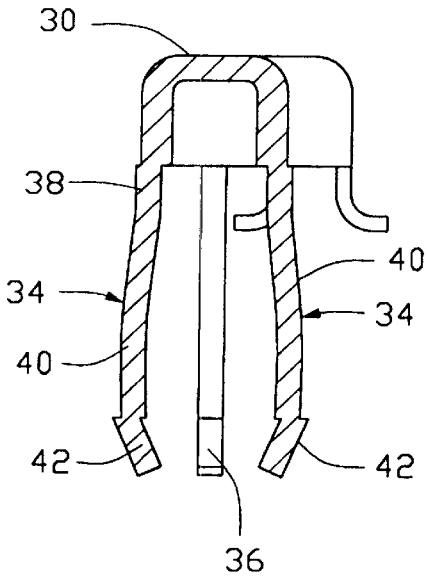
FIG. 4 is a cross-sectional view taken along line 4—4 of FIG. 3.
Figure 5:
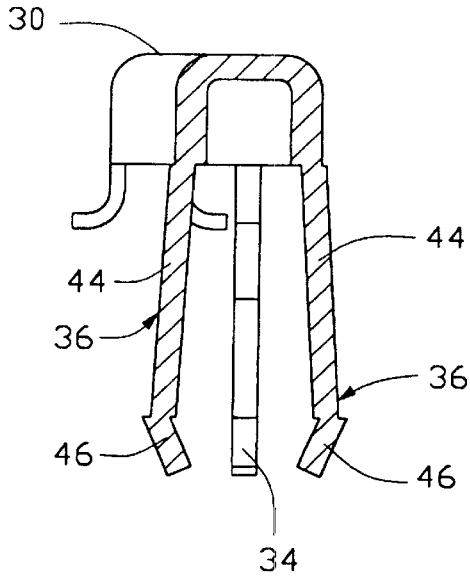
FIG. 5 is a cross-sectional view taken along line 5—5 of FIG. 3.

With particular reference to FIGS. 4 and 5, each first finger 34 has a substantially flaring configuration comprises a substantially straight root portion 38 and an outward concave curved portion 40 extending from the root portion 38. Free ends of the concave portions 40 diverge from each other and each forms a barb 42. The outward concave portions 40 are deflectable upon insertion through a corresponding hole defined in a printed circuit board (not shown). The resiliency of the concave portions 40 of the first fingers 34 helps retaining engagement of the barbs 42 with an edge of the hole of the printed circuit board.

Each second finger 36 comprises a substantially straight portion 44 forming a barb 46 on a free end. The barbs 46 engage the edge of the hole of the printed circuit board after the pawl is inserted into the hole. Preferably, the straight portion 44 diverge with respect to each other with a small inclination for helping maintaining the engagement of the barbs 46 with the hole of the printed circuit board.

The substantially straight configuration imposes less force caused by the resiliency of the fingers 36 against the edge of the hole of the printed circuit board during insertion of the fingers 34, 36 into the hole thereby making it easier to mount the board lock 18 to the printed circuit board.

Figure 6:
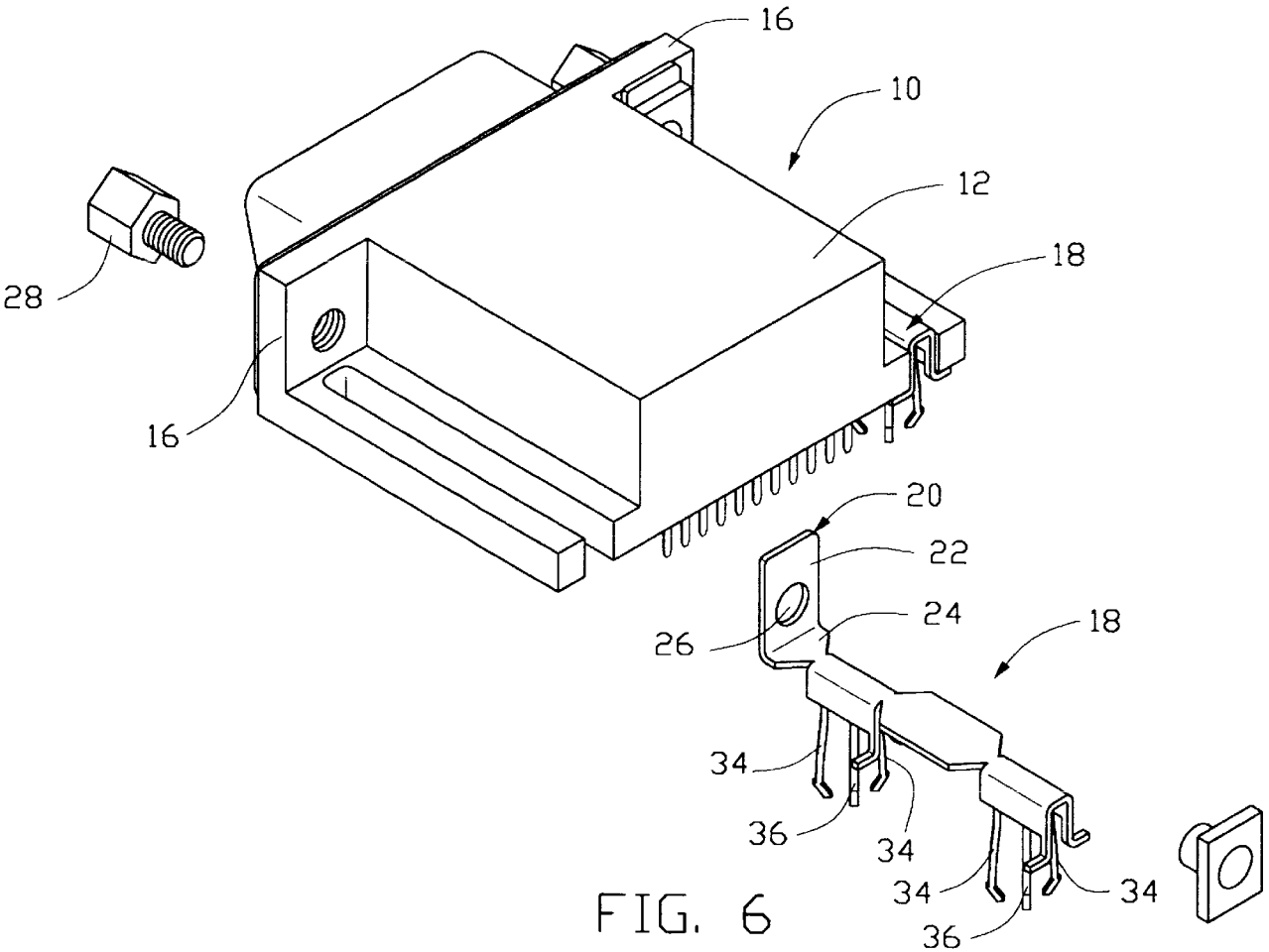
FIG. 6 is a perspective view showing an electrical connector incorporating board locks constructed in accordance with a second embodiment of the present invention.

FIG. 6 shows a second embodiment of the present invention wherein like or corresponding parts are designated with the same numerals as the first embodiment with reference to FIGS. 1–5. The second embodiment comprises two pawls formed with the board lock body 20 and spaced from each other. Similar to the first embodiment, each pawl comprises two first fingers 34 and two second fingers 36. The pawls are received in corresponding holes defined in a printed circuit board for retaining the electrical connector 10 on the printed circuit board during a soldering process.

Figure 2:
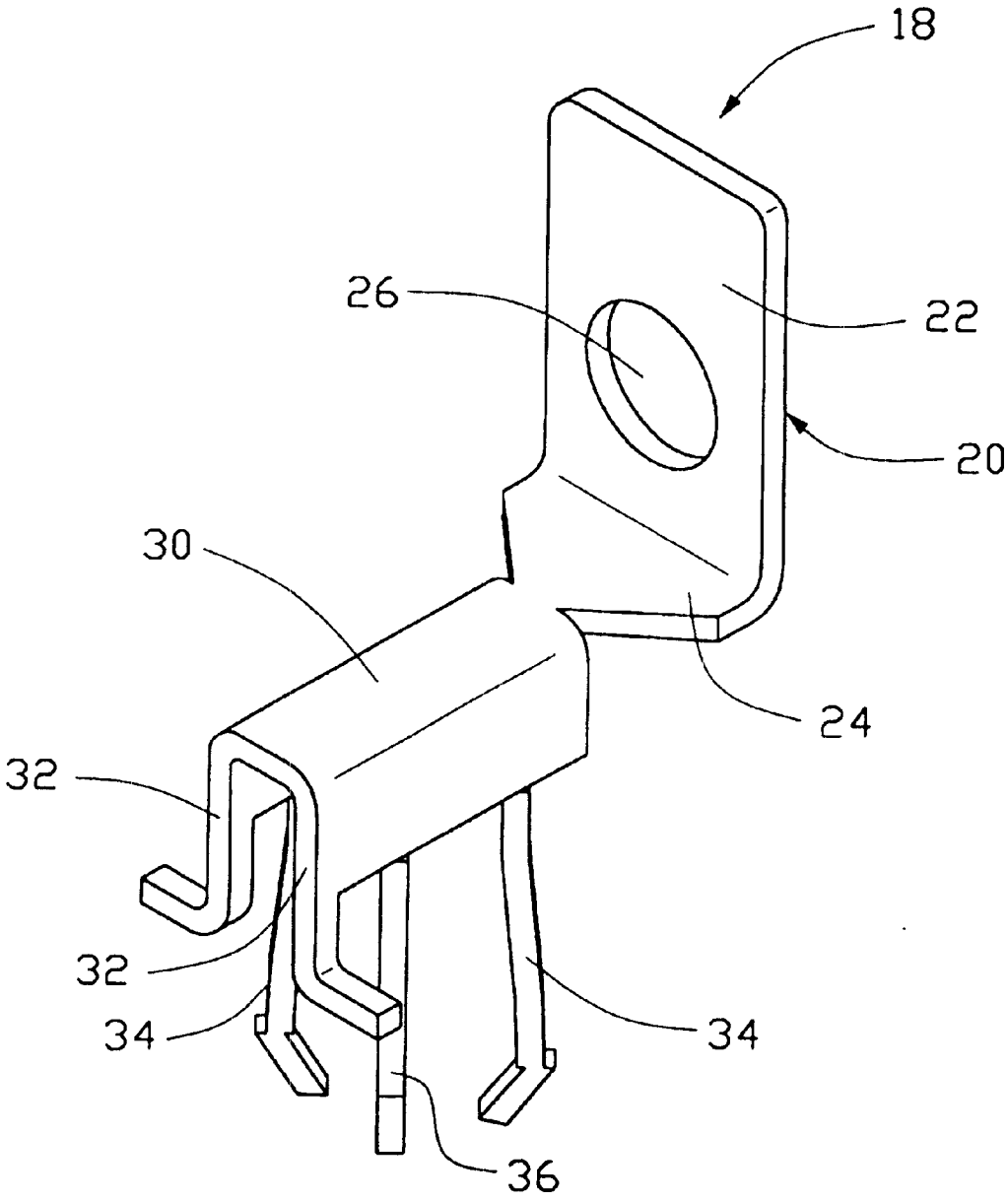
FIG. 2 is a perspective view of the board lock of the first embodiment of the present invention.
Figure 3:
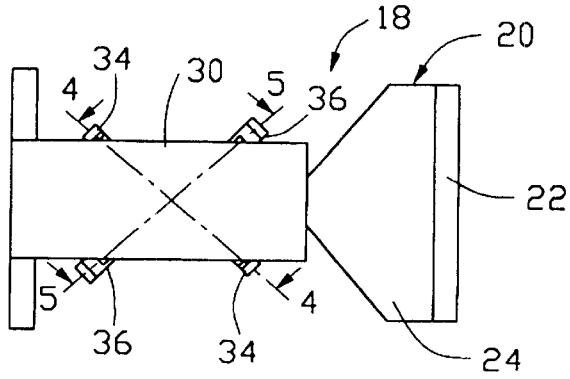
FIG. 3 is a top view of the board lock of FIG. 2.

It is obvious to those having ordinary skills in the art to employ a one-pawl board lock as shown in the first embodiment with reference to FIGS. 1–5 and a two-pawl board lock as shown in the second embodiment with reference to FIG. 2 on opposite sides of a single connector.

Although the present invention has been described and illustrated with the preferred embodiments thereof, it is understood to those having ordinary skills in the arts that variation and modification can be achieved without departing from the spirit and scope of the present invention which is defined by the appended claims.

What is claimed is:

1. A board lock adapted to retain an electronic device on a printed circuit board, the board lock comprising a body attached to the electronic device and one pawl adapted to be received in a hole defined in the printed circuit board, the pawl comprising two first fingers and two second fingers alternating with each other, each first finger comprising a resilient, outwardly concave portion having a free end forming a barb, each second finger comprising a straight portion having a free end forming a barb, the barbs being adapted to engage an edge of the hole of the printed circuit board, the resiliency of the first fingers forcibly retaining the engagement between the barbs and the edge of the hole of the printed circuit board.

2. The board lock as claimed in claim 1, wherein the outwardly concave portions of the first fingers diverge from each other.

3. The board lock as claimed in claim 1, wherein the second fingers diverge from each other with the straight portion of each second finger having an inclination.

4. The board lock as claimed in claim 1, wherein the body comprises a first section attached to the electronic device and a second section extending from the first section, the second section forming a channel-like portion having two side walls from each of which a said first finger and a said second finger extend.

5. The board lock as claimed in claim 4, wherein the second section is substantially normal to the first section, forming an L-shaped configuration.

6. An electrical connector comprising:

a housing retaining conductive contacts therein, at least one side wing formed on one side of the housing; and a board lock comprising a body mounted to the side wing of the housing and at least one pawl adapted to be received in a hole defined in a printed circuit board, the pawl comprising two first fingers and two second fingers alternating with each other, each first finger comprising a resilient, outwardly concave portion having a free end forming a barb, each second finger comprising a straight portion having a free end forming a barb, the barbs being adapted to engage an edge of the hole of the printed circuit board, the resiliency of the first fingers forcibly retaining the engagement between the barbs and the edge of the hole of the printed circuit board.

7. The electrical connector as claimed in claim 6, wherein the outward concave portions of the first fingers of the pawl diverge from each other.

8. The electrical connector as claimed in claim 6, wherein the second fingers of the, pawl diverge from each other with the straight portion of each second finger having an inclination.

9. The electrical connector as claimed in claim 6, wherein the body of the board lock comprises a first section attached to the side wing and a second section extending from the first section, the second section forming a channel-like portion having two side walls from each of which a first finger and a second finger extend.

10. The electrical connector as claimed in claim 9, wherein the second section is substantially normal to the first section, forming an L-shaped configuration.

11. The electrical connector as claimed in claim 9, wherein the first section of the board lock defines a through hole receiving a fastener for securing the board lock to the side wing of the housing.

12. The electrical connector as claimed in claim 6, wherein the board lock comprises two pawls.

13. The electrical connector as claimed in claim 6, wherein the housing comprises two side wings with a board lock attached to each of the side wings, each board lock comprising at least one pawl.

14. The electrical connector as claimed in claim 13, wherein at least one of the board locks comprises two pawls.

* * * * *